US009095991B2

(12) United States Patent
Oswald

(10) Patent No.: US 9,095,991 B2
(45) Date of Patent: Aug. 4, 2015

(54) CONCRETE VIBRATOR HEAD

(75) Inventor: Fred Oswald, Sands Point, NY (US)

(73) Assignee: Oztec Industries, Inc., Port Washington, NY (US)

( * ) Notice: Subject to any disclaimer, the term of this patent is extended or adjusted under 35 U.S.C. 154(b) by 0 days.

(21) Appl. No.: 13/362,372

(22) Filed: Jan. 31, 2012

(65) Prior Publication Data

US 2012/0195156 A1 Aug. 2, 2012

Related U.S. Application Data

(60) Provisional application No. 61/462,254, filed on Jan. 31, 2011.

(51) Int. Cl.

| | |
|---|---|
| ***B01F 11/02*** | (2006.01) |
| ***B28B 1/093*** | (2006.01) |
| ***E04G 21/08*** | (2006.01) |

(52) U.S. Cl.

CPC ..... *B28B 1/0935* (2013.01); *E04G 21/08* (2013.01)

(58) Field of Classification Search

CPC ..... B28B 1/0935
USPC ..... 366/120–124; 601/67–75
See application file for complete search history.

(56) References Cited

U.S. PATENT DOCUMENTS

| | | | | |
|---|---|---|---|---|
| 794,962 | A * | 7/1905 | Waite | 601/72 |
| 867,162 | A | 9/1907 | Seidl | 24/574.1 |
| 1,760,843 | A | 5/1930 | Hasty | 192/71 |
| 1,770,154 | A | 7/1930 | Day | 264/69 |
| 1,844,247 | A * | 2/1932 | Freemon | 601/18 |
| 1,927,075 | A | 9/1933 | Thomas | 366/122 |
| 1,970,740 | A | 8/1934 | Day | 264/31 |
| 1,989,409 | A | 1/1935 | Gordon | 264/69 |
| 2,015,217 | A | 9/1935 | Deniau | 264/69 |
| 2,040,666 | A | 5/1936 | Miller | 264/69 |
| 2,073,393 | A | 3/1937 | Mall | 366/123 |

(Continued)

FOREIGN PATENT DOCUMENTS

| | | | |
|---|---|---|---|
| BE | 428033 | 5/1938 | E04G 21/08 |
| DE | 1946419 | 4/1971 | E04G 21/08 |

(Continued)

OTHER PUBLICATIONS

Notification of Transmittal of the International Search Report and the Written Opinion of the International Searching Authority, Or the Declaration (in English) dated May 11, 2012, International Search Report (in English) dated May 11, 2012 and Written Opinion of the International Searching Authority (in English) dated May 11, 2012.

*Primary Examiner* — David Sorkin
*Assistant Examiner* — Abbas Rashid
(74) *Attorney, Agent, or Firm* — Gerald T. Bodner

(57) ABSTRACT

A concrete vibrator head includes an elongated body having a front end and a back end. The back end of the vibrator head is attached to a rotating shaft which causes the vibrator head to vibrate at a desired vibration frequency. The elongated body is tapered from the front end to approximately halfway towards the back end. This taper may be defined by a continuous straight line slope of the outer surface of the elongated body, or a stepped slope formed from a series of interconnected cylindrical portions of the elongated body which increase in diameter from the front end to approximately midway on the elongated body of the vibrator head.

16 Claims, 4 Drawing Sheets

(56) References Cited

U.S. PATENT DOCUMENTS

| | | | | | |
|---|---|---|---|---|---|
| 2,078,477 | A | | 4/1937 | Whiting | 264/333 |
| 2,080,727 | A | | 5/1937 | Ludeman, Jr. | 366/116 |
| 2,167,987 | A | * | 8/1939 | Mall | 366/122 |
| RE21,684 | E | | 1/1941 | Mall | 366/123 |
| 2,232,842 | A | | 2/1941 | Douglass | 366/122 |
| 2,295,283 | A | | 9/1942 | Mall | 366/123 |
| 2,422,639 | A | * | 6/1947 | Wenander | 74/87 |
| 2,430,817 | A | | 11/1947 | Jackson | 173/170 |
| 2,437,983 | A | * | 3/1948 | Wenander | 366/120 |
| 2,454,620 | A | | 11/1948 | Wilde | 366/121 |
| 2,492,431 | A | | 12/1949 | Kroeckel | 366/122 |
| 2,522,906 | A | | 9/1950 | Smith | 211/1.51 |
| 2,546,806 | A | * | 3/1951 | Wenander | 74/87 |
| 2,597,505 | A | | 5/1952 | Lindkvist | 366/121 |
| 2,603,459 | A | | 7/1952 | McCrery | 366/122 |
| 2,645,944 | A | | 7/1953 | Crichton, Jr. et al. | 74/15.6 |
| 2,705,618 | A | | 4/1955 | Wyzenbeek | 366/122 |
| 2,715,822 | A | | 8/1955 | Anderson | 464/99 |
| 2,800,309 | A | | 7/1957 | Giertz-Hedström | 366/122 |
| 2,820,655 | A | | 1/1958 | Hileman | 403/349 |
| 2,885,232 | A | | 5/1959 | Eberly | 403/202 |
| 3,002,365 | A | | 10/1961 | Liljequist | 464/32 |
| 3,042,386 | A | | 7/1962 | Wyzenbeek | 366/122 |
| 3,109,461 | A | | 11/1963 | Wolff et al. | 138/137 |
| 3,119,275 | A | | 1/1964 | Ambrose | 74/61 |
| 3,152,791 | A | * | 10/1964 | Svensson | 366/120 |
| 3,160,398 | A | * | 12/1964 | Green | 366/61 |
| D200,012 | S | | 1/1965 | Whitman | D15/147 |
| 3,180,625 | A | * | 4/1965 | Wyzenbeek | 366/122 |
| 3,188,054 | A | * | 6/1965 | Mason, Jr. | 366/121 |
| 3,202,402 | A | | 8/1965 | Giertz-Hedström | 366/123 |
| 3,280,439 | A | | 10/1966 | McCarthy | 24/613 |
| 3,283,598 | A | * | 11/1966 | Barnes | 74/87 |
| 3,294,370 | A | * | 12/1966 | Hedelin | 366/120 |
| 3,340,742 | A | * | 9/1967 | Chandler | 74/87 |
| 3,357,267 | A | | 12/1967 | Halilovic et al. | 74/87 |
| 3,395,894 | A | * | 8/1968 | Hedelin | 366/121 |
| 3,551,967 | A | | 1/1971 | Williams | 425/117 |
| 3,580,246 | A | * | 5/1971 | Foreman | 601/72 |
| 3,587,248 | A | | 6/1971 | Umanos | 464/52 |
| 3,608,867 | A | * | 9/1971 | Hunter | 366/120 |
| 3,611,748 | A | | 10/1971 | Wallgren | 464/52 |
| 3,705,578 | A | * | 12/1972 | Cutler et al. | 601/73 |
| 3,735,757 | A | * | 5/1973 | MacFarland | 601/72 |
| 3,743,333 | A | | 7/1973 | Kosinski | 403/343 |
| 3,773,304 | A | * | 11/1973 | Hodgson | 366/61 |
| 3,779,238 | A | * | 12/1973 | Cutler et al. | 601/73 |
| 3,836,124 | A | | 9/1974 | Malan | 366/122 |
| 3,929,321 | A | * | 12/1975 | Sims | 220/4.01 |
| 3,933,341 | A | * | 1/1976 | Hudelmaier | 366/57 |
| 3,961,774 | A | | 6/1976 | Strohbeck et al. | 366/108 |
| 3,976,284 | A | * | 8/1976 | Hupp | 366/62 |
| D249,665 | S | * | 9/1978 | Silbernagel | D12/95 |
| 4,196,755 | A | | 4/1980 | Kutnyak et al. | 138/150 |
| 4,293,231 | A | | 10/1981 | Lyle | 366/120 |
| 4,295,496 | A | | 10/1981 | Bixby | 138/122 |
| 4,313,432 | A | * | 2/1982 | Sievers | 601/75 |
| 4,392,836 | A | | 7/1983 | Sugawara | 464/52 |
| 4,428,678 | A | | 1/1984 | Lyle | 366/124 |
| 4,522,499 | A | * | 6/1985 | Hudelmaier | 366/56 |
| 4,585,355 | A | * | 4/1986 | Waitzinger | 366/55 |
| D291,547 | S | * | 8/1987 | Silbernagel | D12/95 |
| 4,756,623 | A | * | 7/1988 | Bishop | 366/57 |
| 4,812,327 | A | | 3/1989 | Hanazawa et al. | 427/388.4 |
| 4,878,489 | A | * | 11/1989 | Kamayachi | 601/72 |
| 4,896,986 | A | | 1/1990 | Terayama | 403/14 |
| 5,056,924 | A | * | 10/1991 | Christenson | 366/59 |
| 5,108,189 | A | | 4/1992 | Oswald | 366/123 |
| 5,149,302 | A | | 9/1992 | Yano | 464/52 |
| 5,556,199 | A | | 9/1996 | Oswald | 366/120 |
| 5,641,238 | A | | 6/1997 | Oswald | 403/359.3 |
| 5,688,063 | A | * | 11/1997 | Yu et al. | 401/195 |
| 5,884,998 | A | * | 3/1999 | Silbernagel | 366/41 |
| 6,065,859 | A | * | 5/2000 | Breeding | 366/121 |
| 6,155,708 | A | | 12/2000 | Lindley | 366/123 |
| 6,239,507 | B1 | | 5/2001 | Douthit | 290/55 |
| 6,352,518 | B1 | * | 3/2002 | nee Wolf | 601/89 |
| D456,034 | S | | 4/2002 | Oswald | D15/147 |
| 6,811,297 | B2 | | 11/2004 | Oswald | 366/122 |
| 6,843,777 | B2 | * | 1/2005 | Togno | 601/55 |
| 6,902,311 | B1 | * | 6/2005 | Khouri et al. | 366/54 |
| 6,960,011 | B2 | | 11/2005 | Oswald et al. | 366/108 |
| 7,101,075 | B2 | * | 9/2006 | Silbernagel | 366/62 |
| 7,766,849 | B2 | * | 8/2010 | Nan | 601/70 |
| 2002/0131323 | A1 | | 9/2002 | Oswald | 366/122 |
| 2003/0023194 | A1 | * | 1/2003 | Togno | 601/70 |
| 2003/0111753 | A1 | | 6/2003 | Oswald | 264/35 |
| 2004/0208080 | A1 | | 10/2004 | Oswald et al. | 366/123 |
| 2005/0187498 | A1 | * | 8/2005 | Miller | 601/72 |
| 2005/0235442 | A1 | * | 10/2005 | Molter | 15/93.1 |
| 2008/0259715 | A1 | * | 10/2008 | Harris et al. | 366/18 |

FOREIGN PATENT DOCUMENTS

| | | | |
|---|---|---|---|
| DE | 4440921 | 5/1995 | |
| EP | 0532793 | 3/1993 | B06B 1/16 |
| GB | 699580 | 11/1953 | B06B 1/16 |
| GB | 979469 | 1/1965 | E04G 21/08 |
| JP | 07048927 | 2/1995 | E04G 21/08 |

* cited by examiner

CONCRETE VIBRATOR HEAD

CROSS-REFERENCE TO RELATED APPLICATIONS

This application is based on U.S. Provisional Application Ser. No. 61/462,254, which was filed on Jan. 31, 2011, and is entitled "Improved Concrete Vibrator Head", the disclosure of which is hereby incorporated by reference and on which priority is hereby claimed.

BACKGROUND OF THE INVENTION

1. Field of the Invention

The present invention generally relates to tools and equipment used in the construction industry, and more specifically relates to devices for mixing and consolidating concrete. Even more specifically, the present invention relates to concrete vibrators.

2. Description of the Prior Art

In the construction industry, it is frequently necessary to lay a large area of concrete. Concrete is a mixture of cement, sand and stone. Lime is an ingredient in cement, and water is added to the mixture to form a mix or slurry.

After the wet concrete has been poured, it is common practice in the industry to vibrate the concrete. The ingredients of concrete do not flow easily. Concrete vibrators are introduced into the mix and send out shock waves. The shock waves unlock the ingredients and allow the concrete mix to flow while moving the entrapped air out. Concrete vibrators are used to consolidate the concrete and remove air pockets and voids which would otherwise compromise the strength and integrity of the hardened concrete.

Conventional concrete vibrators are well known in the art, such as described and shown in Applicant's U.S. Pat. No. 6,811,297 (Oswald) and U.S. Patent Application Publication No. 2002/0131323 (Oswald), the disclosure of each of which is incorporated herein by reference.

When a concrete vibrator is lowered into poured wet concrete to consolidate it, and vibrated at a frequency of about 10,000 to about 12,000 vibrations per minute, it was discovered by the inventor herein that the nose or front end of the concrete vibrator head pushes the concrete away faster than it can flow back. More specifically, as the vibrator head sinks into the wet concrete, it drills a hole in proportion to the diameter of the head and the total height of the vibration's amplitude. Wet concrete has high viscosity and is slow to move and make contact with the vibrator head to close the hole drilled by the head. This results in only a small portion (i.e., the front end) of the vibrator head coming in contact with the concrete to effectively vibrate the mix.

Physical evidence by examining a worn vibrator head shows that the nose (front end) is worn, while a short distance back from the nose, there appears to be little or no wear. This demonstrates that the vibrator head has little contact with the abrasive wet concrete. The result is that most of the shock waves are developed from the front of the vibrator head.

OBJECTS AND SUMMARY OF THE INVENTION

It is an object of the present invention to provide an improved concrete vibrator head.

It is another object of the present invention to provide a vibrator head for consolidating concrete which works more effectively to consolidate concrete than conventional vibrator heads.

In one form of the present invention, an improved concrete vibrator head includes an elongated body having a front end and a back end situated axially opposite the front end. The back end of the vibrator head is attached to a rotating shaft which causes the vibrator head to vibrate at a desired vibration frequency. In the improved vibrator head, the elongated body is tapered from the front end to approximately halfway towards the back end. This taper may be defined by a continuous straight line slope of the outer surface of the elongated body, or a stepped slope, in other words, a series of interconnected cylindrical portions of the elongated body which increase in diameter from the front end to approximately midway on the elongated body of the vibrator head.

In addition, in another form of the present invention, the improved concrete vibrator head may have a similar taper to that of the front end extending from the back end to the midway or halfway point of the elongated body, either with a straight line slope or a stepped slope.

The improved concrete vibrator head, with its tapered elongated body, may be formed with either a tapered steel core, or a tapered or untapered steel core covered with a tapered rubber, plastic or urethane covering.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
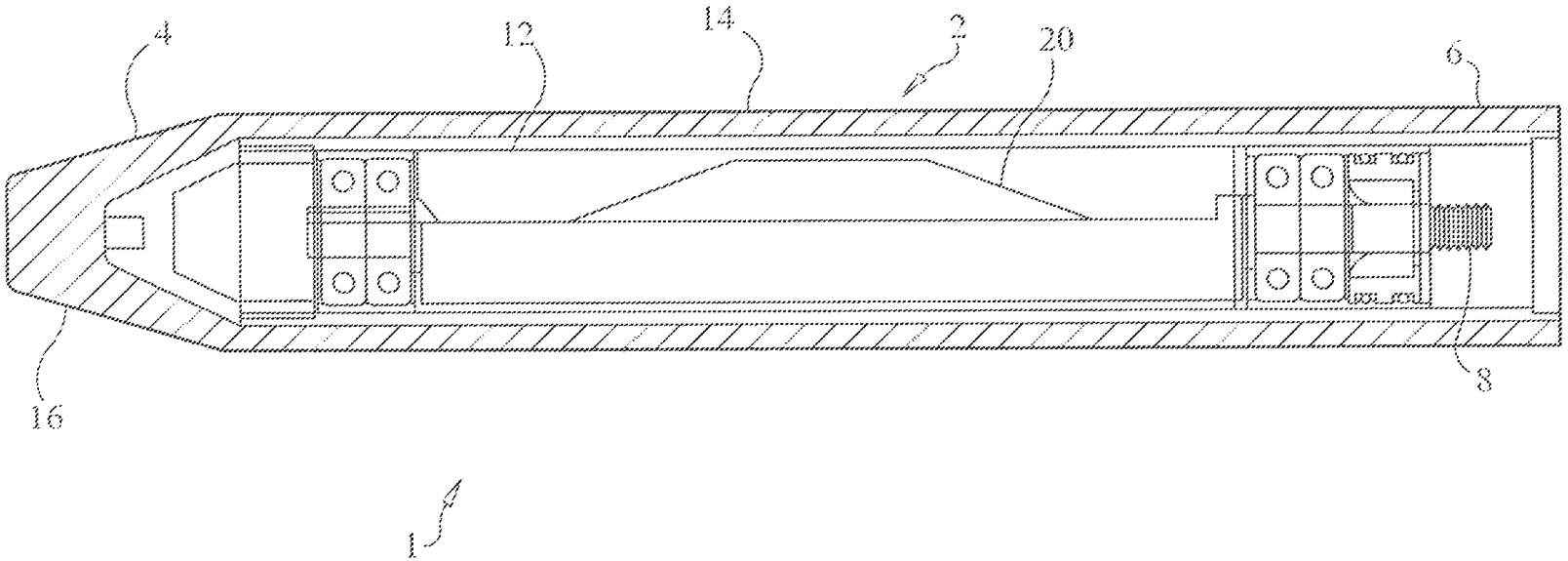
FIG. 1 (PRIOR ART)
FIG. 1 is a cross-sectional view of a conventional concrete vibrator head.

As can be seen in FIG. 1 of the drawings, a conventional concrete vibrator head 1 includes an elongated body 2 having a front end 4 and a back end 6 situated axially opposite the front end 4. The elongated body 2 on its front end 4 is slightly cone-shaped to more easily penetrate the wet poured concrete. The back end 6 of the vibrator head 1 includes an exteriorly threaded shaft 8, which is received by an interiorly complementary threaded bore of a flexible shaft 10 (see FIGS. 4 and 5), whose other axial end is connected to a drive motor (not shown) to cause the flexible shaft 10 to rotate which, in turn, causes the vibrator head 1 to vibrate at a desired frequency.

More specifically, the conventional vibrator head 1 includes an elongated body 2 defined by a tubular steel core 12 and an outer covering 14. The steel core 12 has a substantially constant diameter along the axial length thereof, except at its forward most end 16, where it is formed into the shape of a cone or truncated cone, or is rounded in shape. This steel core 12 is covered with a rubber, plastic or urethane covering 14 which conforms to the shape of the steel core and has, therefore, also a constant diameter along its length, except where it covers the forward most end 16 of the steel core 12, where it is formed also with a conical, truncated conical or rounded shape.

Within the interior bore of the tubular steel core 12 is situated an eccentric (such as an axially off center weight) 20, which rotates with rotation of the flexible shaft 10 to cause the vibrator head 1 to move radially and vibrate. This vibration transmits shock waves through the poured concrete which help to consolidate the poured concrete and remove any air pockets and voids therefrom.

It has been found by the inventor herein that contact between the vibrator head 1 and the wet concrete appears to be limited to the front end, or nose, 4 of the vibrator head when the head is vibrated. This is because of the consistency of the wet concrete, as the vibrator head 1 pushes the concrete away from the outer surface of the elongated body 2 faster than it can flow back. Thus, only a small portion, i.e., the nose or front end 4 of the vibrator head 1, effectively vibrates the concrete mix. A solution to this problem is a tapered vibrator head, which will result in constant contact with the wet concrete as the head moves down into the concrete mass.

Figure 2:
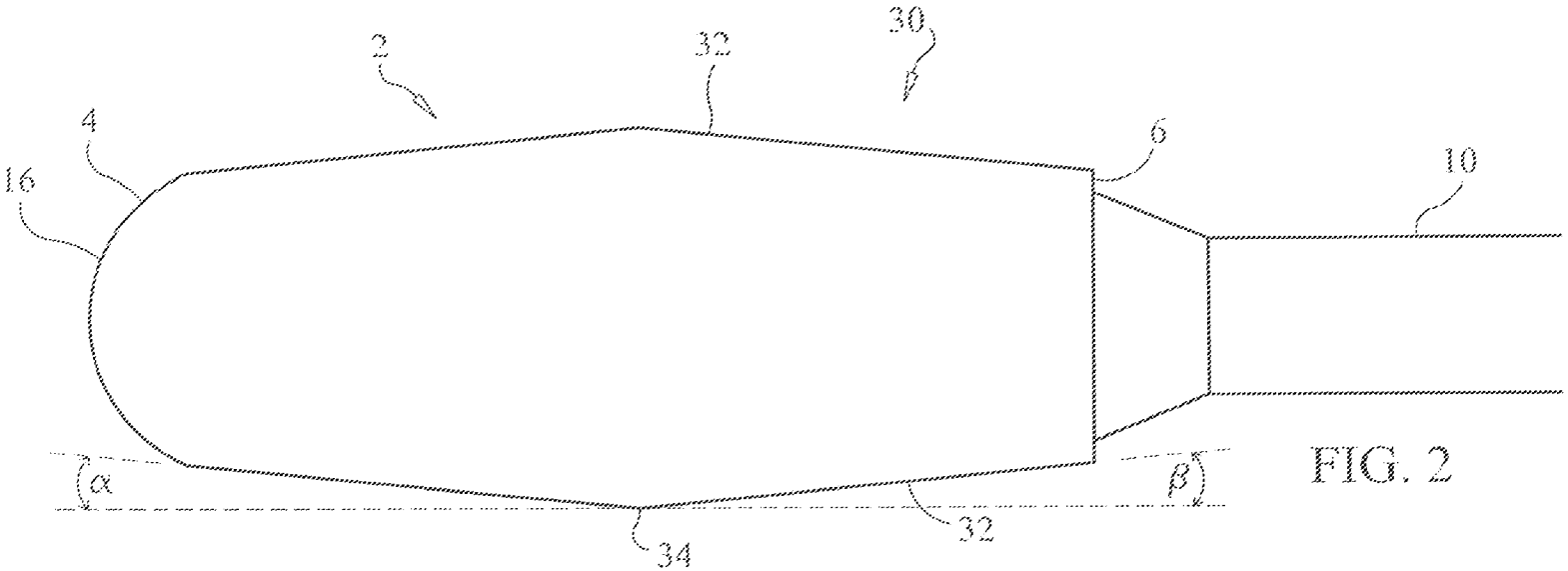
FIG. 2 is a side view depiction of the improved concrete vibrator head formed in accordance with the present invention and exhibiting a straight line slope or taper on its outer surface.
Figure 3:
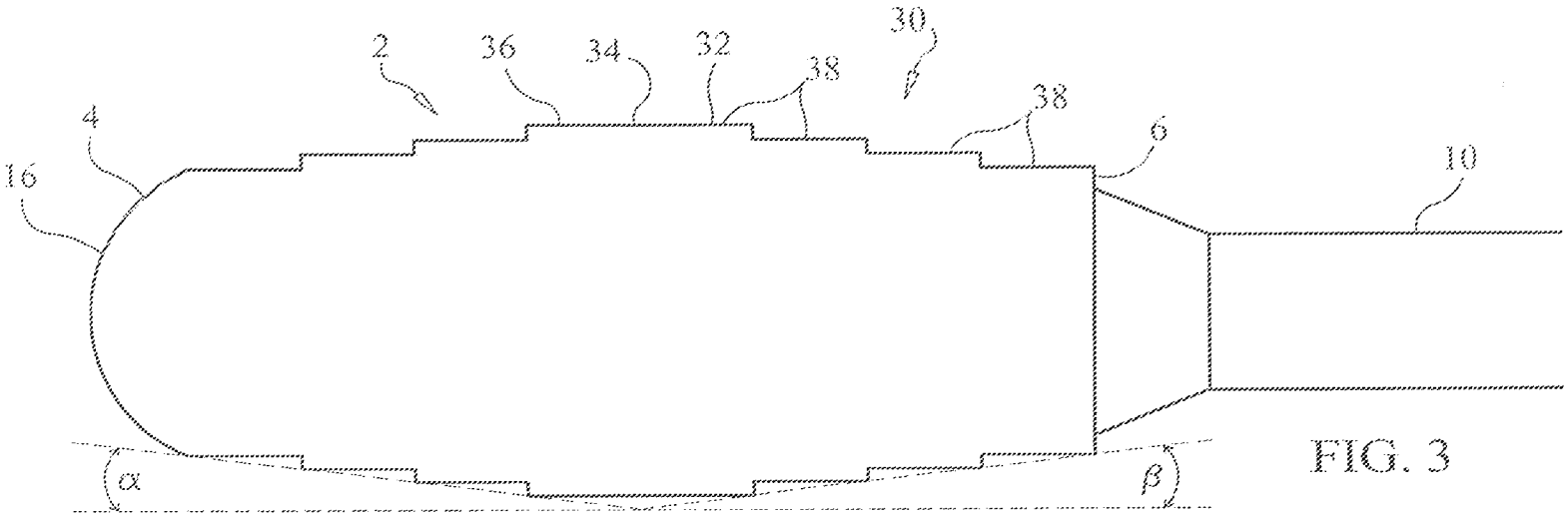
FIG. 3 is a side view depiction of the improved concrete vibrator head formed in accordance with the present invention and exhibiting a stepped slope or taper on its outer surface.
Figure 4:
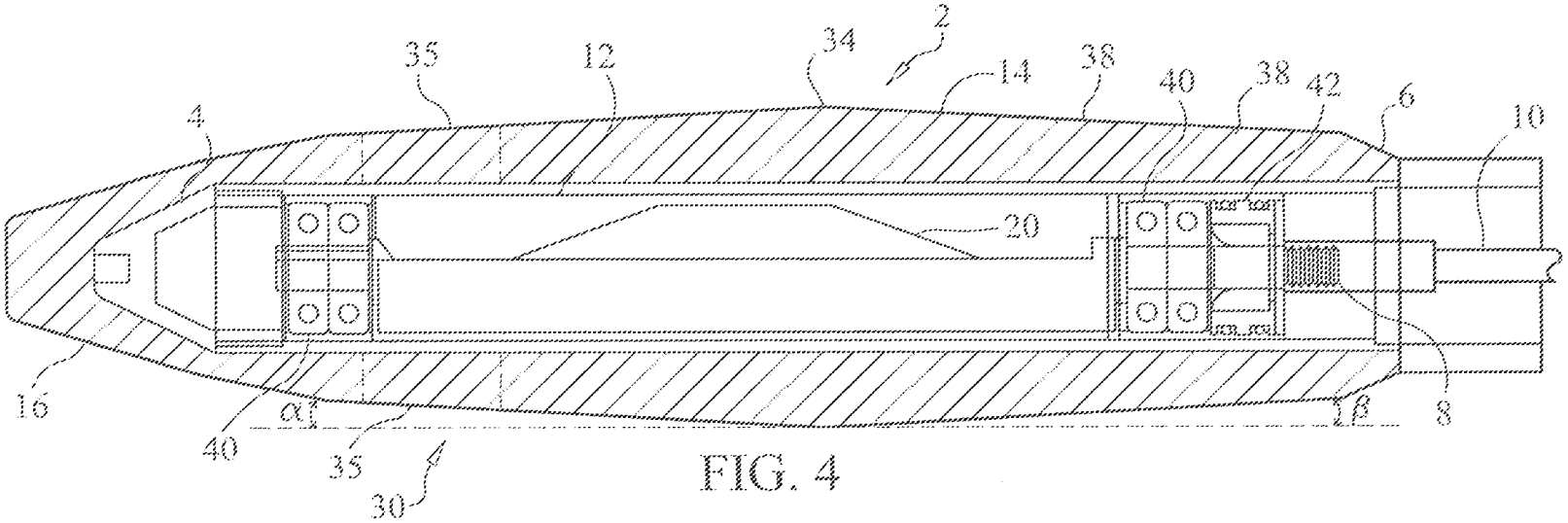
FIG. 4 is a more detailed cross-sectional view depiction of the improved concrete vibrator head formed in accordance with the present invention and exhibiting a straight line slope or taper on its outer surface.

Accordingly, the inventor herein has improved upon the conventional concrete vibrator head, the improved vibrator head 30 being shown by way of example in FIGS. 2-5 of the drawings. More specifically, and as shown in FIGS. 2 and 4 of the drawings, the improved vibrator head 30 may include a straight line, continuous slope or taper of its outer wall or surface 32 over the front portion of the elongated body that extends from near the front end or nose 4 to approximately the midpoint 34 of the elongated body 2 such that the diameter of the elongated body 2 near the front end or nose 4 thereof is less than the diameter of the elongated body measured at about the midpoint 34 of the elongated body. In a further preferred embodiment, the elongated body 2 of the improved concrete vibrator head 30 may include a reverse continuous slope or taper on its outer surface 32 over the back portion of the elongated body, that is, from about the midpoint 34 of the elongated body 2 where the diameter thereof is greatest, toward a relatively smaller diameter back end 6, as shown in the drawings.

The preferred angle of taper or slope $\alpha$ of the outer surface 32, as shown in FIGS. 2-5 of the drawings, would be selected to correspond with the amplitude of the vibrations from the front end 4 to the midpoint 34 of the elongated body 2. If, for example, it is envisioned to vibrate the head 30 at an amplitude that would cause a conventional vibrator head 1, such as shown in FIG. 1, to create a ⅛ inch gap in the wet concrete surrounding the head, then the preferred angle of taper a of the front half portion of the elongated body 2 of the improved vibrator head 30 would be, perhaps, about 10 degrees, measured as an exterior angle on the outer surface 32 of the elongated body 2 from the midpoint 34 thereof toward the nose 4 (see FIGS. 2 and 3). If, however, it is required to vibrate the head at an even greater amplitude such that a conventional vibrator head 1, vibrating with this amplitude, would cause a ¼ inch gap to form in the wet concrete surrounding the head, then it is preferred to form the front half portion of the elongated body 2 of the improved vibrator head 30 with a greater angle of taper or slope, such as about 15 degrees. Thus, it is envisioned the angle of slope $\alpha$ may range from about 5° to about 20° over the front portion of the elongated body 2. When the front half portion of the elongated body 2 of the improved concrete vibrator head 30 is formed with such a taper, contact between the poured wet concrete and the outer wall 32 of the vibrator head during operation will be maximized as the vibrator head 30 is pushed in a forward direction in the concrete. Also, with a similar but reverse angle of taper 13 provided to the rear half portion of the elongated body 2 of the vibrator head 30, contact between the rear half portion of the vibrator head and the poured wet concrete will also be maximized as the vibrator head 30 is pulled in a reverse direction in the concrete which is opposite the forward direction.

FIGS. 2 and 4 illustrate an embodiment of the improved concrete vibrator head 30 in which the outer surface or wall 32 of the elongated body 2 is formed with an axially continuous, straight line slope from near the nose 4 to the midpoint 34 and from the midpoint to at least near the back end 6. However, in an alternative form of the present invention shown in FIGS. 3 and 5 of the drawings, the vibrator head 30 may be formed with a series of increasing diameter portions 36 from near the front end 4 of the elongated body 2 to about the midpoint 34 thereof, where the elongated body 2 would have the greatest diameter, and, preferably, in a reverse direction with decreasing diameter portions 8 from about the midpoint 34 of the elongated body 2 to at least near the back end 6 thereof, to define the outer wall or surface 32 of the elongated body 2 with a stepped slope or taper. The overall angle of slope $\alpha$ of the stepped outer wall or surface 32 of the elongated body 2 of the vibrator head 30 will, like the straight line sloped outer surface 32 of the vibrator head shown in FIGS. 2 and 4, depend on the amplitude of vibrations in the concrete caused by the vibrator head 30 and the degree to which the wet concrete is displaced by the operation of the vibrator head. It is envisioned that the angle of slope $\beta$ of the back portion of the elongated body may also be about 10° or about 15°, or may be in the range of about 5° to about 20°.

Figure 5:
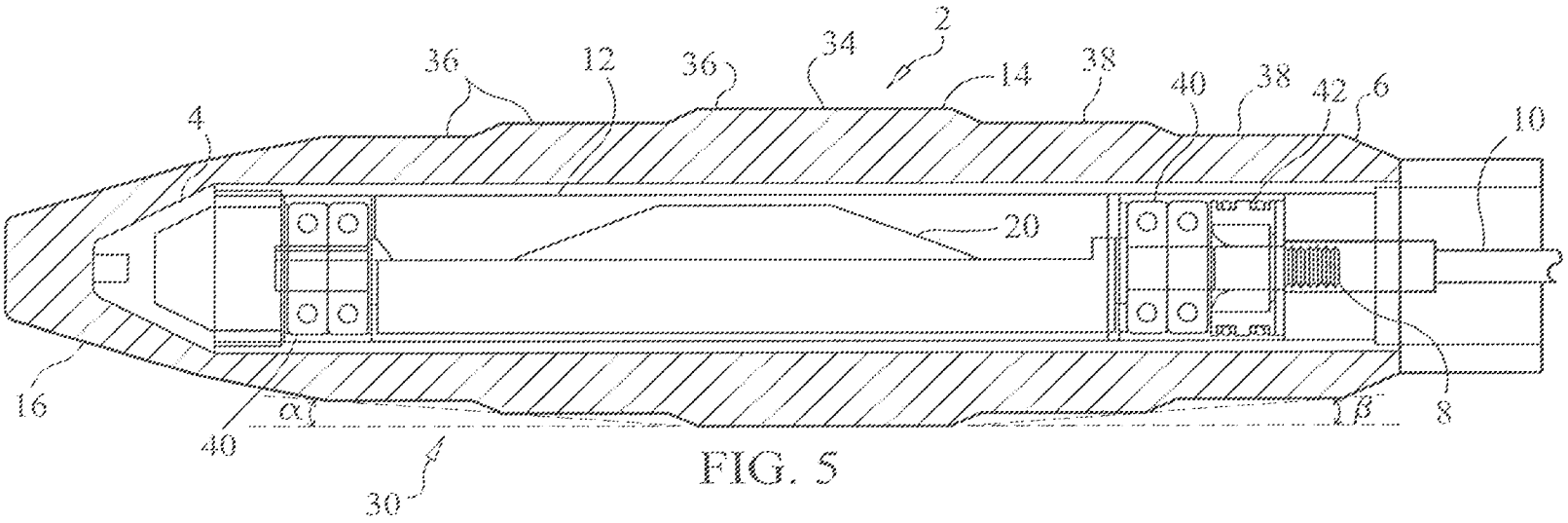
FIG. 5 is a more detailed cross-sectional view depiction of the improved concrete vibrator head formed in accordance with the present invention and exhibiting a stepped slope or taper on its outer surface.

As mentioned previously, the elongated body 2 of the vibrator head 30 could be formed with only a steel or metal tubular core 12 which is tapered as described herein, the outer surface of which contacts the concrete. Alternatively, the steel core 12 could be either tapered or have a constant diameter along its axial length, and include a covering 14 of plastic, rubber, urethane or like material situated on the outer surface of the steel or metal core 12, where the covering's outer surface 32 is formed with the taper described herein, as shown in FIGS. 4 and 5 of the drawings.

It is envisioned that, when the steel core 12 of the vibrator head 30 is sheathed with the rubberized covering 14, the covering 14 includes apertures or openings 35 passing therethrough, which function as suction cups to hold wet concrete tight against the vibrating metallic core, as described in the aforementioned U.S. Patent Application Publication No. 2002/0131323, but also help in cooling the steel core 12 by allowing the cooler, wet concrete to contact the core.

It should be noted that the vibrator head 30 of the present invention preferably further has the structure of the conventional vibrator head 1 shown in FIG. 1, including the eccentric 20, bearings 40 situated within the bore of the core 12 near opposite axial ends thereof, oil seal or seals 42, threaded shaft 8 for attachments to flexible shaft 10, and other internal components, and a conical, truncated conical or rounded nose 4, except for the shape of the elongated body 2 and any other differences described herein.

Since most vibrator operators allow the vibrator head to sink into the concrete under its own weight, the downward motion is slow. The withdrawal of the vibrator head is much faster, since there is a tendency to yank the vibrator head quickly out of the wet concrete. Therefore, in another preferred form of the present invention, the improved vibrator head 30 may be formed with an outer surface 32 having a slope that is lower in the downward direction or front portion of the head than in the upward direction or back portion of the head closer to the back end 6 where the flexible shaft 10 is attached.

Figure 6:
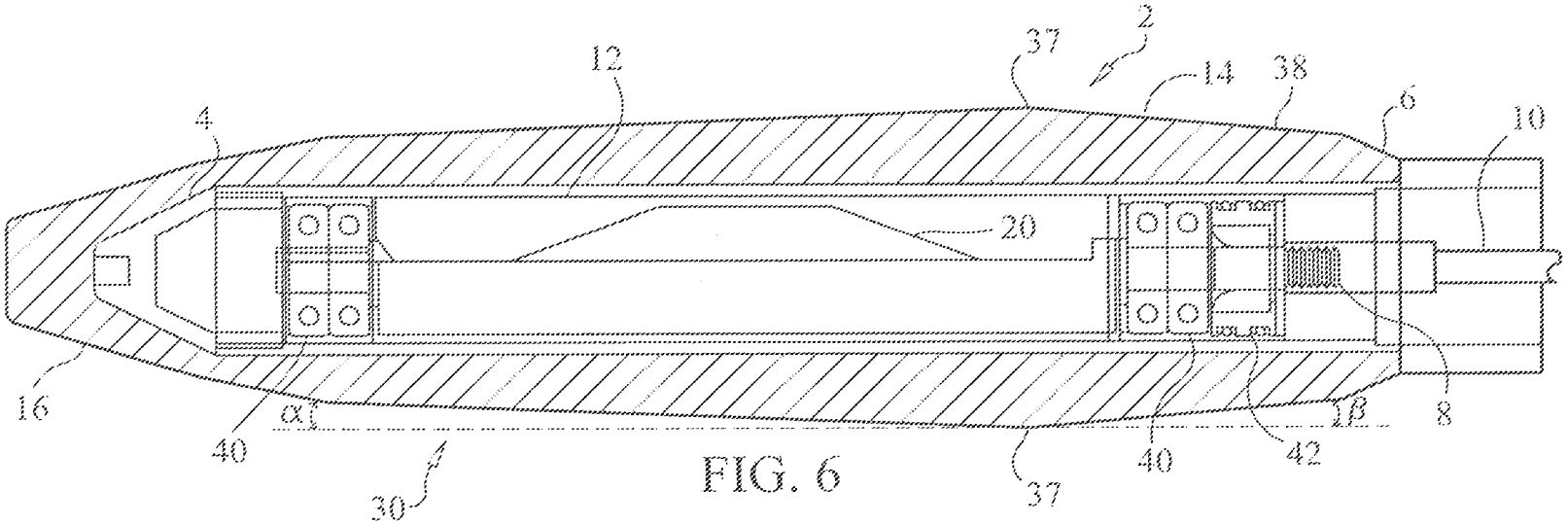
FIG. 6 is a detailed cross-sectional view depiction of the improved concrete vibrator head constructed in accordance with another form of the present invention and exhibiting a straight line slope or taper on its outer surface.
Figure 7:
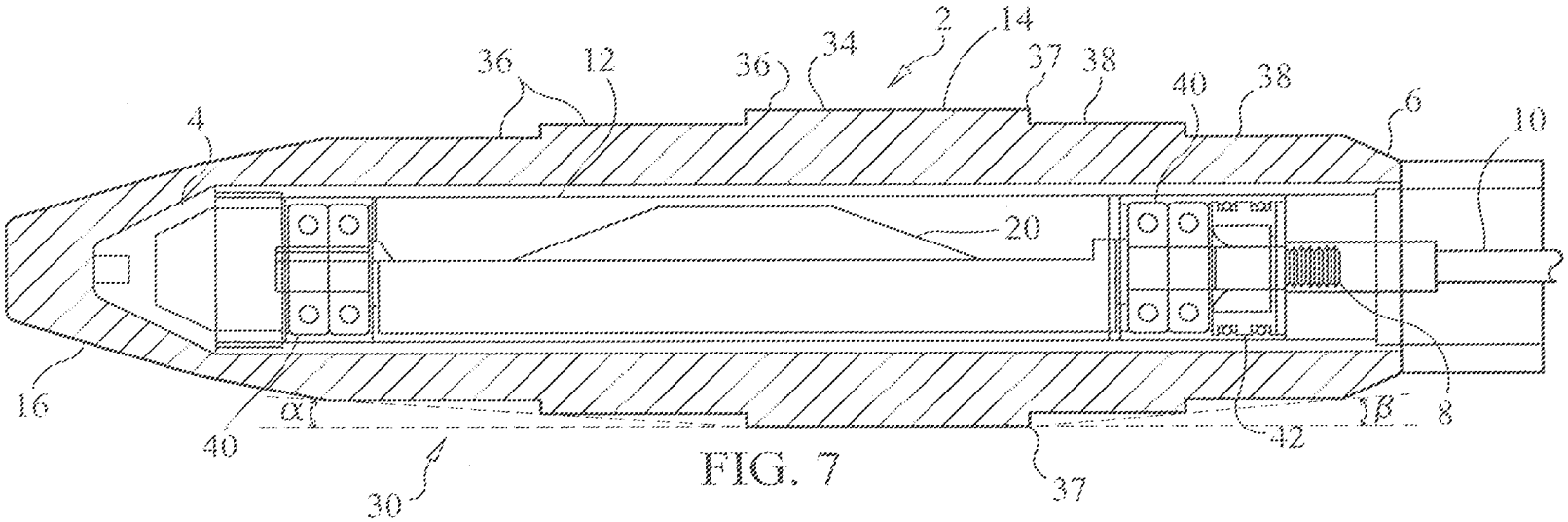
FIG. 7 is a detailed cross-sectional view depiction of the improved concrete vibrator head constructed in accordance with another form of the present invention which is similar in many respects to the vibrator head shown in FIG. 6, except exhibiting a stepped slope or taper on its outer surface.

More specifically, and as can be seen in FIGS. 6 and 7 of the drawings, the slope of the outer surface 32 of the elongated body 2 need not change at the midpoint 34, as shown in the embodiments of FIGS. 2-5. Rather, the taper or slope of the outer surface 32 over the front portion of the elongated body 2 may extend beyond the midpoint 34 of the elongated body 2 to a location 37 on the elongated body which is closer to the back end 6 of the elongated body. At this location on the outer surface 32 of the elongated body 2, that is, where the front portion meets the back portion, the slope over the back portion of the elongated body may reverse from that of the front portion and continue towards the back end 6 of the elongated body, with the slope over the back portion of the elongated body 2 being greater than that of the outer surface 32 over the front portion of the elongated body.

Thus, the slope of the outer surface 32 of the elongated body 2 may increase from near the nose or front end 4 of the elongated body to a location 37 which is situated beyond the midpoint 34 of the elongated body and closer to the back end 6. This location 37 where the front taper ends is preferably situated at about three-quarters, or about 75 percent, of the axial length of the elongated body 2 of the vibrator head 30, measured from the nose 4 of the elongated body, but in another preferred form of the present invention, could be situated between about five-eighths, or about 62.5 percent, to about seven-eighths, or about 87.5 percent, of the axial length of the elongated body 2 measured from the nose 4 thereof. FIG. 6 shows an embodiment of the vibrator head 30 in which the elongated body 2 has an outer surface or wall 32 formed with an axially continuous, straight line slope from near the nose 4 to the location 37 at the juncture of the front portion and the back portion on the outer surface 32, and again with a reverse continuous slope from this location 37 to the back end 6 of the elongated body 2, which structure is similar to that of the vibrator head 30 shown in FIGS. 2 and 4. FIG. 7 shows an embodiment of the vibrator head 30 which is very similar to that shown in FIGS. 3 and 5, and which is formed with a series of increasing diameter portions 36 from near the front end 4 of the elongated body 2 to the front portion/back portion juncture location 37 on the outer surface 32, near where the elongated body 2 would have the greatest diameter, and, preferably, having decreasing diameter portions 38 on the outer surface 32 of the elongated body from the front portion/back portion juncture location 37 thereon to the back end 6 thereof. The location 37 where the front portion meets the back portion on the elongated body 2 in the stepped embodiment shown in FIG. 7 is at the same preferred location on the outer surface 32 of the elongated body 2 as described previously with respect to the axially continuous, straight line slope embodiment of the vibrator head 30 shown in FIG. 6 of the drawings, that is, preferably at the three-quarter location or within a range of about five-eighths to about seven-eighths from the front end of the elongated body 2.

With the embodiments of the vibrator head 30 shown in FIGS. 6 and 7, it is envisioned that the angle of slope $\alpha$ of the outer surface 32 over the front portion of the elongated body 2 is about 5°, and the angle of slope $\beta$ of the outer surface 32 over the back portion of the elongated body is between about 10° and about 15°.

It should be understood that the taper or slope over the front portion of the elongated body 2 and the taper or slope over the back portion of the elongated body may vary depending on the conditions of concrete stiffness and size of the vibration head 30. The objective is to have the concrete always be in constant contact as much as possible with the vibrator head.

The improved concrete vibrator head of the present invention, formed with the straight line or stepped taper or slope, will tend to be in contact with the wet concrete along a greater axial length thereof than with conventional vibrator heads. Thus, more vibrations are transmitted by the vibrator head into the concrete, which will improve the consolidation of the concrete and further facilitate the removal of air pockets and voids therefrom.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A concrete vibrator head, which comprises:

an elongated body having a front end and a back end situated axially opposite the front end, and an outer surface situated between the front end and the back end, the outer surface having a continuously varying diameter over the axial length thereof between the front end and the back end of the elongated body, the elongated body defining an interior bore;

means situated at the back end of the elongated body for connecting the elongated body to a flexible rotatable shaft; and a rotatable eccentric situated within the interior bore of the elongated body, the eccentric, when rotated, causing the elongated body to move radially and to vibrate, the elongated body, when moving radially and vibrating, transmitting shock waves into a volume of a concrete mixture into which the concrete vibrator head is placed;

wherein the outer surface includes a front sloping segment having a conical shape and a back sloping segment having a conical shape and being axially adjacent the front sloping segment, the front sloping segment of the outer surface meeting the back sloping segment of the outer surface at a common circumferential line on the outer surface of the elongated member, the front sloping segment of the outer surface having a forward taper which slopes at a first fixed angle over the entire length of the front sloping segment in that the diameter of the outer surface over the front sloping segment continuously decreases linearly in diameter in a direction from the common circumferential line toward the front end of the elongated body, the back sloping segment of the outer surface having a rearward taper which slopes at a second fixed angle over the entire length of the back sloping segment in that the diameter of the outer surface over the back sloping segment continuously decreases linearly in diameter in a direction from the common circumferential line toward the back end of the elongated body; and wherein, when the concrete vibrator head is placed in the volume of the concrete mixture and the elongated body thereof is caused to vibrate, the front sloping segment of the concrete vibrator head contacts and transmits shock waves into the volume of the concrete mixture when the concrete vibrator head is moved in the concrete mixture in a first direction, and the back sloping segment of the concrete vibrator head contacts and transmits shock waves into the volume of the concrete mixture when the concrete vibrator head is moved in the concrete mixture in a second direction which is opposite the first direction.

2. A concrete vibrator head as defined by claim 1, wherein the forward taper of the front sloping segment of the outer surface is about 10 degrees.

3. A concrete vibrator head as defined by claim 1, wherein the forward taper of the front sloping segment of the outer surface is about 15 degrees.

4. A concrete vibrator head as defined by claim 1, wherein the rearward taper of the back sloping segment of the outer surface is about 10 degrees.

5. A concrete vibrator head as defined by claim 1, wherein the rearward taper of the back sloping segment of the outer surface is about 15 degrees.

6. A concrete vibrator head as defined by claim 1, wherein the location of the common circumferential line on the outer surface of the elongated body where the front sloping segment meets the back sloping segment is axially situated about midway on the elongated body.

7. A concrete vibrator head as defined by claim 1, wherein the elongated body includes a tubular metal core, the outer surface of the elongated body being situated on the tubular metal core.

8. A concrete vibrator head as defined by claim 1, wherein the elongated body includes a tubular metal core and an outer covering which covers at least a portion of the tubular metal core, the outer surface of the elongated body being situated on the outer covering.

9. A concrete vibrator head as defined by claim 1, wherein the location of the common circumferential line on the outer surface of the elongated body where the front sloping segment meets the back sloping segment is axially situated about three-quarters of the axial length of the elongated body measured from about the front end thereof.

10. A concrete vibrator head as defined by claim 9, wherein the forward taper of the front sloping segment of the outer surface is about 5 degrees.

11. A concrete vibrator head as defined by claim 9, wherein the rearward taper of the back sloping segment of the outer surface is between about 10 degrees and about 15 degrees.

12. A concrete vibrator head as defined by claim 1, wherein the location of the common circumferential line on the outer surface of the elongated body where the front sloping segment meets the back sloping segment is axially situated in the range of about five-eighths to about seven-eighths of the axial length of the elongated body measured from about the front end thereof.

13. A concrete vibrator head as defined by claim 12, wherein the forward taper of the front sloping segment of the outer surface is about 5 degrees.

14. A concrete vibrator head as defined by claim 12, wherein the rearward taper of the back sloping segment of the outer surface is between about 10 degrees and about 15 degrees.

15. In combination:

a volume of a concrete mixture; and a concrete vibrator head immersed in the volume of the concrete mixture and movable therein in a first direction and in a second direction which is opposite the first direction, the concrete vibrator head comprising:

an elongated body having a front end and a back end situated axially opposite the front end, and an outer surface situated between the front end and the back end, the outer surface having a continuously varying diameter over the axial length thereof between the front end and the back end of the elongated body, the elongated body defining an interior bore;

means situated at the back end of the elongated body for connecting the elongated body to a flexible rotatable shaft; and a rotatable eccentric situated within the interior bore of the elongated body, the eccentric, when rotated, causing the elongated body to move radially and to vibrate, the elongated body, when moving radially and vibrating, transmitting shock waves into the volume of the concrete mixture in which the concrete vibrator head is immersed;

wherein the outer surface includes a front sloping segment and a back sloping segment axially adjacent the front sloping segment, the front sloping segment of the outer surface meeting the back sloping segment of the outer surface at a common circumferential line on the outer surface of the elongated member, the front sloping segment of the outer surface having a forward taper in that the diameter of the outer surface over the front sloping segment continuously decreases in diameter in a direction from the common circumferential line toward the front end of the elongated body, the back sloping segment of the outer surface having a rearward taper in that the diameter of the outer surface over the back sloping segment continuously decreases in diameter in a direction from the common circumferential line toward the back end of the elongated body; and wherein, when the concrete vibrator head is immersed in the volume of the concrete mixture and the elongated body thereof is caused to vibrate, the front sloping segment of the concrete vibrator head contacts and transmits shock waves into the volume of the concrete mixture when the concrete vibrator head is moved in the concrete mixture in the first direction, and the back sloping segment of the concrete vibrator head contacts and transmits shock waves into the volume of the concrete mixture when the concrete vibrator head is moved in the concrete mixture in the second direction which is opposite the first direction.

16. A method of consolidating a volume of a concrete mixture, which comprises the steps of:

immersing a concrete vibrator head in the volume of the concrete mixture, the concrete vibrator head including:

an elongated body having a front end and a back end situated axially opposite the front end, and an outer surface situated between the front end and the back end, the outer surface having a continuously varying diameter over the axial length thereof between the front end and the back end of the elongated body, the elongated body defining an interior bore;

means situated at the back end of the elongated body for connecting the elongated body to a flexible rotatable shaft; and a rotatable eccentric situated within the interior bore of the elongated body, the eccentric, when rotated, causing the elongated body to move radially and to vibrate, the elongated body, when moving radially and vibrating, transmitting shock waves into the volume of the concrete mixture into which the concrete vibrator head is immersed;

wherein the outer surface includes a front sloping segment and a back sloping segment axially adjacent the front sloping segment, the front sloping segment of the outer surface meeting the back sloping segment of the outer surface at a common circumferential line on the outer surface of the elongated member, the front sloping segment of the outer surface having a forward taper in that the diameter of the outer surface over the front sloping segment continuously decreases in diameter in a direction from the common circumferential line toward the front end of the elongated body, the back sloping segment of the outer surface having a rearward taper in that the diameter of the outer surface over the back sloping segment continuously decreases in diameter in a direction from the common circumferential line toward the back end of the elongated body;

rotating the eccentric within the interior bore of the concrete vibrator head to cause the elongated body to move radially and to vibrate, the radially moving and vibrating elongated body transmitting the shock waves into the volume of the concrete mixture in which the concrete vibrator head is immersed;

moving the concrete vibrator head in the volume of the concrete mixture in a first direction, wherein the front sloping segment of the concrete vibrator head contacts and transmits shock waves into the volume of the concrete mixture; and moving the concrete vibrator head in the volume of the concrete mixture in a second direction which is opposite the first direction, wherein the back sloping segment of the concrete vibrator head contacts and transmits shock waves into the volume of the concrete mixture.

* * * * *